US006013344A

United States Patent [19]

Corbins

[11] Patent Number: 6,013,344

[45] Date of Patent: Jan. 11, 2000

[54] COSMETIC BLOTTER

[76] Inventor: Curtis Corbins, 306 Sandy Creek Dr., DeSoto, Tex. 75115

[21] Appl. No.: 09/114,011

[22] Filed: Jul. 10, 1998

[51] Int. Cl.[7] ..... B32B 1/04

[52] U.S. Cl. ..... 428/66.7; 428/64.1; 428/80; 428/99; 132/320

[58] Field of Search ..... 428/64.1, 66.7, 428/80, 99; 132/320

[56] References Cited

U.S. PATENT DOCUMENTS 2,735,435 2/1956 Feinstein ..... 132/320

*Primary Examiner*—Alexander Thomas

*Attorney, Agent, or Firm*—Crutsinger & Booth; James O. Dixon

[57] ABSTRACT

Disclosed is a lipstick blotter having sheet-like main body of generally circular shape and a thickness of from about one to about three millimeters, the periphery of said body having a plurality of generally arced cutouts spaced about the periphery to allow the user to position lips around the cutouts to blot freshly applied lipstick, the blotter having at least one handle member extending from said main body, the blotter being of a soft absorbent polyether polyurethane material.

16 Claims, 1 Drawing Sheet

COSMETIC BLOTTER

BACKGROUND OF INVENTION

This invention relates to cosmetic implements and more particularly to a lipstick blotter.

It is well known that most women prefer to "blot" lipstick on their lips after applying it. A presently preferred blotter is a facial tissue such as Kleenex or other soft disposable paper sheet. Facial tissues and other commonly used blotting materials have disadvantages of being generally too large in area for convenience, of being so flimsy as to require both hands of the user to properly position it for use, of being so flimsy and absorbent of thin material such as saliva as to be likely to tear and to leave bits of the tissue on the lips if somehow wetted. Further, after use for blotting, tissues if saved for use tend to crumple or wad up when placed in a purse for any length of time and then become difficult to find and when found difficult to reform for further use in blotting.

Use of ordinary typing or bond paper for blotting tends to be uncomfortable to the user and has the potential to inflict painful "paper cuts" unless carefully used. Further, ordinary paper is not as absorbent of freshly applied lipstick as might be desirable.

SUMMARY OF INVENTION

The present invention comprises a shaped lipstick blotter of disposable material of sufficient body or stiffness to hold its shape but not so stiff as to be likely to present a cutting edge. The material of the blotter of the present invention is soft for comfort and use, absorbent of freshly applied lipstick but not so absorbent of thin moisture as to be without substantial "wet strength."

DESCRIPTION OF THE DRAWINGS

The above noted objects and advantages of the present invention will become apparent from reading the following detailed description with reference to the accompanying drawings wherein.

DETAILED DESCRIPTION OF THE INVENTION

Figure 1:
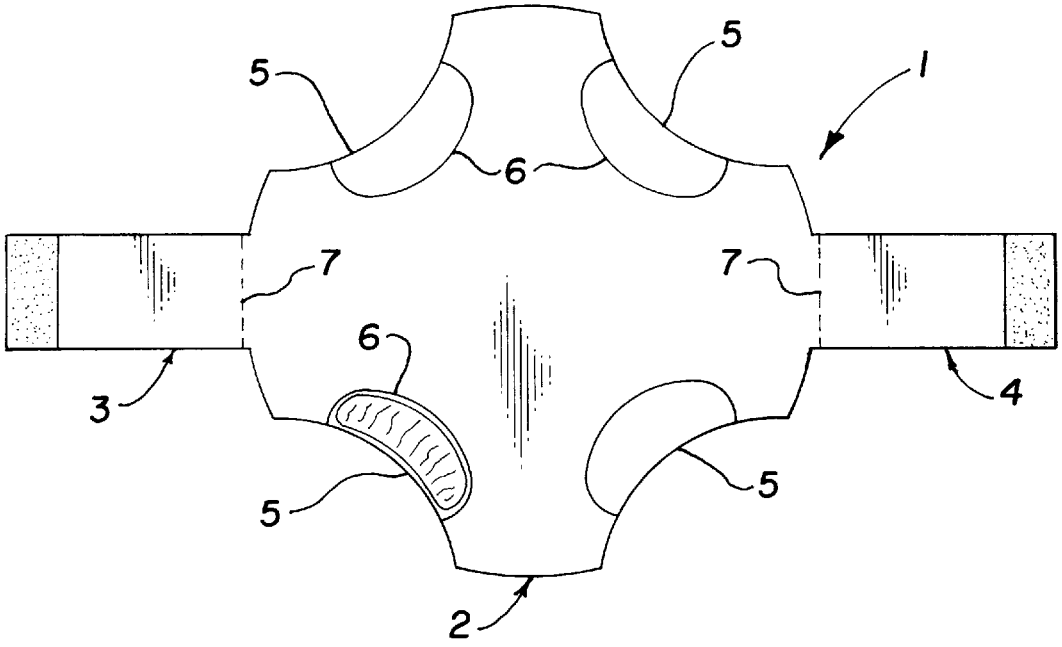
FIG. 1 shows a plan view of one embodiment of the blotter of the present invention.

With reference now to FIG. 1 there is shown a lipstick blotter 1 according to the present invention. The blotter 1 has a body 2 of a generally round or oval shape. Handles 3 and 4 extend from generally opposite sides of the body 2. Body 2 has a plurality of generally arcuate scallops or notches 5 spaced about its periphery between handles 3 and 4.

Blotter 1 may be made of a disposable material such as paper or polyether polyurethane foam. It should have a textured but not rough finish and be relatively soft. If paper it may be about the thickness, stiffness and absorbency of old-fashioned ink blotter sheet. If of foam it may be of a type commonly used in the cosmetic industry as an applicator for makeup bases and powder. The thickness of the blotter should be from about one millimeter to about three millimeters depending on the material used for the blotter. In any instance the material of the blotter should be stiff enough not to buckle or flop over when held by either handle.

Figure 2:
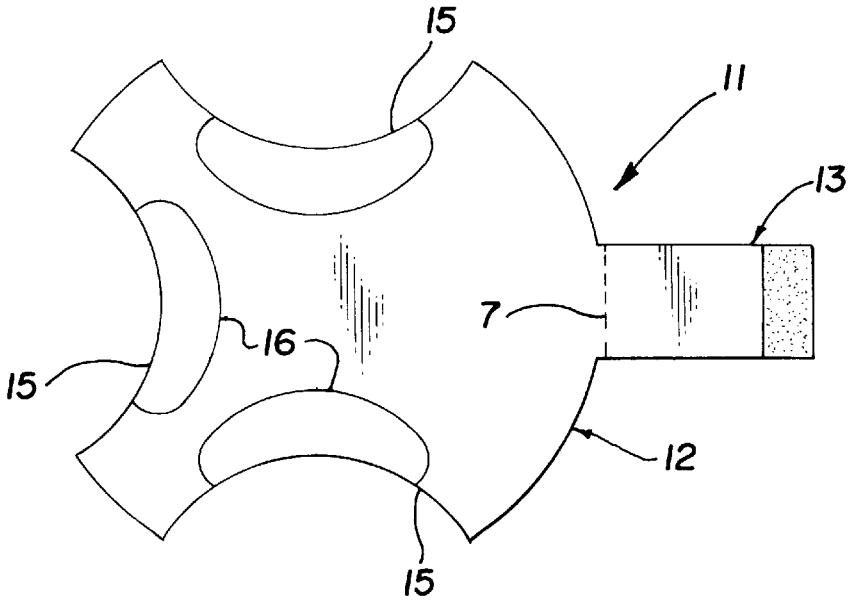
FIG. 2 shows a plan view of a second embodiment of the blotter of the present invention.

FIG. 2 illustrates a second embodiment 11 of the present invention much like the embodiment of the blotter of FIG. 1. Blotter 11 also has a generally round or oval shaped body 12 but with only a single handle 13. Scallops or notches 15 are spaced around the body 12 of the blotter. As with the blotter of FIG. 1 the scallops 5 or 15 may be of any convenient number although they are shown to be four and three in number, respectively, Additionally, optional features that may be incorporated into either of the embodiments shown include guide printing or shading around the notches 5 or 15, fold lines across the handles 3, 4 and 13 as well as tip coloring at the ends of the handles 3, 4 and/or 13.

The guide printing may take the form of what appear to be lip impressions 6 printed very lightly in gray, pale blue or some other color not traditionally used in lipstick. Alternatively, the guide printing may take the form of lightly printed outlines 16.

Fold lines 7 imprinted between the body 2 and handles 3 and 4 and between the body 12 and handle 14 serve to indicate where blotters 1 and 11 may be folded to fit into a convenient carrying case or powder compact. The folded handles provide a convenient means for easily removing the blotters one at a time from a carrying case should there be a number of blotters contained in the case.

The materials as mentioned previously, the blotters 1 and 11 may be of suitable paper material similar to an ink blotter sheet or even soft paper towel such as "Viva" brand towels produced by Scott Paper Company of Delaware County, Pennsylvania. The preferred material, however, is a foam material sold under the brand name Nolatex by Lendell Manufacturing Inc. of St. Charles, Mich. The material is described as polyether polyurethane and has physical properties as follows:

TABLE 1

| Physical Properties of LMI Nolatex Cosmetic Foam | LMI |
|---|---|
| Core Density, pcf | 5.8 |
| Tear Strength, lbf/in | 2.4 |
| Sag Factor | 2.5 |
| Density lb/ft3 | 4.8 |
| Density kg/m3 | 77.2 |
| Hysteresis | 28.2 |
| Recovery | 71.8 |
| Thickness | 2.0 |
| ILD 25% R | 31.0 |
| ILD 65% R | 77.7 |
| ILD 25% RRT | 22.3 |
| COMFORT FACTOR | 0.4 |
| Comp. Set 50% 1A % ct | 11.7 |
| Comp. Set 50% 1A % cd | 22.9 |
| Comp. Set 50% 1H % ct | 3.9 |
| Comp. Set 50% 1H % cd | 7.6 |
| Comp. Set 50% 2E % ct | 35.3 |
| Comp. Set 50% 2E % cd | 71.1 |
| Tensile (psi) | 27.4 |
| Tensile (kpa) | 189.0 |
| Elogation % | 338.9 |
| Tear D3574 avg.ph | 6.5 |
| Tear D3574 max.pli | 6.9 |
| Tear Die "C" avg.pli | 6.4 |
| CLD 50% | 1.0 |
| CLD 50% R | 0.8 |
| % Expansion In Isopropyl Alcohol | 13.0 |
| Wet Out, minutes | 5.0 |
| % Volume Swell (Saturated) | 56.0 |
| Water Retention | |
| Saturated | 23.0 |
| After Wringing | 3.8 |

Thus, having disclosed specific embodiments of a shaped lipstick blotter of improved utility and convenience, it is to be understood that changes and modifications still within the spirit of the invention may occur to others from the reading of this specification and thus the scope of the invention is to be limited only as set forth by the following claims.

What is claimed is:

1. A lipstick blotter having a sheet-like main body of closed arcuate shape and a thickness of from about one millimeter to about three millimeters the periphery of said body having a plurality of generally arcuate cutouts spaced about its periphery at intervals sufficient to allow a user's lips to be positioned against said blotter around any of said cutouts for the blotting of freshly applied lipstick, at least one handle member extending from said main body between a pair of adjacent cutouts said body and handle being of a soft absorbent material selected from materials consisting of polyether polyurethane and papers.

2. The blotter of claim 1 wherein said closed arcuate shape is generally oval.

3. The blotter of claim 2 wherein said soft absorbent material is a formed polyether polyurethane.

4. The blotter of claim 1 wherein said closed arcuate shape is generally circular.

5. The blotter of claim 4 wherein said at least one handle comprises a pair of handles one extending from the opposite side of said main body from the other of said handles.

6. The blotter of claim 5 wherein said soft absorbent material is a paper material.

7. The blotter of claim 5 wherein said soft absorbent material is a formed polyether polyurethane.

8. The blotter of claim 4 wherein said soft absorbent material is a paper material.

9. The blotter of claim 4 wherein said soft absorbent material is a formed polyether polyurethane.

10. The blotter of claim 1 wherein said at least one handle comprises a pair of handles one extending from the opposite side of said main body from the other of said handles.

11. The blotter of claim 10 wherein said soft absorbent material is a paper material.

12. The blotter of claim 10 wherein said soft absorbent material is a formed polyether polyurethane.

13. The blotter of claim 1 wherein said soft absorbent material is a paper material.

14. The blotter of claim 1 wherein said soft absorbent material is a formed polyether polyurethane.

15. A lipstick blotter having a sheet-like main body of generally circular shape and a thickness of from about one millimeter to about three millimeters the periphery of said body having a plurality of generally arced cutouts spaced about its periphery at intervals sufficient to allow a user's lips to be positioned against said blotter around one of said cutouts for the blotting of freshly applied lipstick, at least one handle member extending from said main body between a pair of adjacent cutouts, said body and said at least one handle being of soft absorbent foamed polyether polyurethane material.

16. The blotter of claim 15 wherein said foamed polyether polyurethane material has the physical characteristics set out in Table 1 of the foregoing specification.

* * * * *